US007257961B2

(12) United States Patent
Lee et al.

(10) Patent No.: US 7,257,961 B2
(45) Date of Patent: Aug. 21, 2007

(54) VIBRATION REDUCTION TYPE REFRIGERATOR

(75) Inventors: Dong-Hoon Lee, Incheon (KR); Tae-Hee Lee, Seoul (KR); Yong-Gu Kim, Seoul (KR); Young-Hoon Yun, Daegu (KR)

(73) Assignee: LG Electronics Inc., Seoul (KR)

( * ) Notice: Subject to any disclaimer, the term of this patent is extended or adjusted under 35 U.S.C. 154(b) by 125 days.

(21) Appl. No.: 11/025,907

(22) Filed: Jan. 3, 2005

(65) Prior Publication Data

US 2005/0257553 A1 Nov. 24, 2005

(30) Foreign Application Priority Data

May 18, 2004 (KR) ..... 10-2004-0035352

(51) Int. Cl.
*F25D 19/00* (2006.01)

(52) U.S. Cl. ..... 62/295; 62/296

(58) Field of Classification Search ..... 62/295–296, 62/277–278; 181/403
See application file for complete search history.

(56) References Cited

U.S. PATENT DOCUMENTS

| | | | | |
|---|---|---|---|---|
| 2,010,546 | A | 8/1935 | Kenney | |
| 2,185,198 | A * | 1/1940 | Huggins | 62/203 |
| 2,661,836 | A * | 12/1953 | Jewell | 206/320 |
| 6,260,373 | B1 * | 7/2001 | Rockwood | 62/295 |
| 2002/0157412 | A1 | 10/2002 | Iwanami et al. | |

FOREIGN PATENT DOCUMENTS

| | | | |
|---|---|---|---|
| DE | 39 11 269 | A1 | 10/1990 |
| EP | 1 302 143 | A1 | 4/2003 |
| EP | 1 557 623 | A1 | 7/2005 |
| JP | 6-147728 | * | 6/1994 |
| JP | 9-264658 | A | 10/1997 |
| JP | 2002-39665 | A | 2/2002 |
| JP | 2002-81851 | A | 3/2002 |
| KR | 1998-062992 | | 11/1998 |
| KR | 10-2000-0027340 | | 5/2000 |

* cited by examiner

*Primary Examiner*—William E. Tapolcai
(74) *Attorney, Agent, or Firm*—Birch, Stewart, Kolasch & Birch, LLP

(57) ABSTRACT

Disclosed is a vibration reduction type refrigerator including a refrigerator main body having a cooling chamber for storing foods and a mechanical chamber, a compressor disposed in the mechanical chamber, for compressing refrigerants, and a suction pipe connected to the side of the compressor, disposed in the mechanical chamber in the width direction of the refrigerator main body, and connected to an outlet pipe of an evaporator disposed at one side end of the mechanical chamber. The vibration reduction type refrigerator can prevent the vibration generated by the compressor from being transmitted to the refrigerator main body through the suction pipe and the discharge pipe connected to the compressor, by minimizing spaces occupied by the suction pipe and the discharge pipe in the mechanical chamber and increasing the length of the suction pipe and the discharge pipe.

21 Claims, 6 Drawing Sheets

VIBRATION REDUCTION TYPE REFRIGERATOR

BACKGROUND OF THE INVENTION

1. Field of the Invention

The present invention relates to a vibration reduction type refrigerator, and more particularly to, a vibration reduction type refrigerator which can prevent vibration generated by a compressor from being transmitted to a refrigerator main body through pipes.

2. Description of the Background Art

In general, a refrigerator includes a refrigerator main body having a cooling chamber for storing various foods, and a refrigeration cycle for refrigerating the cooling chamber.

The application range of the refrigerator has been gradually expanded, such as a cosmetics refrigerator and a wine refrigerator for storing cosmetics and wines, respectively. As a variety of refrigerators are developed, researches have been made to reduce vibration of the refrigerators.

Especially, in the wine refrigerator, temperature, sunlight, humidity, vibration and horizontality must be taken into consideration to handle and store wines. It is quite easy to control sunlight, humidity and horizontality but difficult to maintain an optimum temperature and reduce vibration. Thus, researches have still been made on it.

FIG. 1 is a perspective view illustrating a mechanical chamber of a conventional refrigerator, and FIG. 2 is a cross-sectional view illustrating the mechanical chamber of the conventional refrigerator.

The conventional refrigerator includes a refrigerator main body 102 having a freezing chamber for storing various frozen foods and a cooling chamber for storing various cooled foods, and a mechanical chamber 106 disposed at the rear bottom portion of the refrigerator main body 102, for housing various components of a refrigeration cycle, such as a compressor 104 for compressing refrigerants.

Doors 108 for opening or closing the freezing chamber and the cooling chamber are mounted at the front portion of the refrigerator main body 102, and feet 110 for supporting the refrigerator main body 102 to control the height are mounted at the lower portion of the refrigerator main body 102.

A cover 112 for opening or closing the mechanical chamber 106 is fastened to the front portion of the mechanical chamber 106 by screws 114, a control box 116 for controlling the refrigeration cycle is installed at one side of the inside portion of the mechanical chamber 106, a water tray 118 for storing water generated from the refrigeration cycle by defrosting is installed at the upper portion of the inside portion of the mechanical chamber 106, a base plate 120 is mounted on the bottom surface of the mechanical chamber 106, and the compressor 104 is mounted on the base plate 120.

The compressor 104 is mounted on the base plate 120 by mounting brackets 122, and rubber vibration isolators 124 for preventing vibration generated by the compressor 104 from being transmitted to the refrigerator main body 102 are installed at the mounting brackets 122. The compressor 104 is connected to an evaporator (not shown) installed at the rear portion of the refrigerator main body 102 through a suction pipe 130, for sucking refrigerants from the evaporator, and also connected to a condenser (not shown) installed at the rear portion of the refrigerator main body 102 through a discharge pipe 132, for discharging the compressed refrigerants to the condenser.

The suction pipe 130 and the discharge pipe 132 are looped once and connected respectively to the evaporator and the condenser so as to prevent the vibration generated by the compressor 104 from being transmitted to the refrigerator main body 102 through the pipes 130 and 132. That is, the suction pipe 130 and the discharge pipe 132 are wound once in a loop shape.

In the conventional refrigerator, in order to increase the capacity of the cooling chamber as large as possible, the width of the mechanical chamber is set to be almost identical to the size of the compressor. In addition, the condensed water tray is installed at the upper portion of the mechanical chamber. It is thus restrictive to increase the length of the suction pipe and the discharge pipe. Even though the suction pipe and the discharge pipe are looped once to increase the length, the length of the suction pipe and the discharge pipe is so short that the vibration generated by the compressor may be transmitted to the refrigerator main body through the suction pipe and the discharge pipe. As a result, shelves of the refrigerator are shaken.

Especially, in the wine refrigerator, noise is a very important factor. The vibration transmitted to the cooling chamber badly ripens the wines.

SUMMARY OF THE INVENTION

Therefore, an object of the present invention is to provide a vibration reduction type refrigerator which can prevent vibration generated by a compressor from being transmitted to a refrigerator main body through a suction pipe and a discharge pipe connected to the compressor, by minimizing spaces occupied by the suction pipe and the discharge pipe in a mechanical chamber and increasing the length of the suction pipe and the discharge pipe.

To achieve these and other advantages and in accordance with the purpose of the present invention, as embodied and broadly described herein, there is provided a vibration reduction type refrigerator, including: a refrigerator main body having a cooling chamber for storing foods and a mechanical chamber; a compressor disposed in the mechanical chamber, for compressing refrigerants; and a suction pipe connected to the side of the compressor, disposed in the mechanical chamber in the width direction of the refrigerator main body, and connected to an outlet pipe of an evaporator disposed at one side end of the mechanical chamber.

Preferably, a water tray for storing water generated in the operation of a refrigeration cycle is mounted on the top surface of the mechanical chamber, and disposed at a predetermined interval from the rear wall surface of the mechanical chamber, so that a space can be formed between the side of the water tray and the rear wall surface of the mechanical chamber.

Preferably, the suction pipe includes: a first pipe unit connected to the side of the compressor; a second pipe unit connected to the first pipe unit, for passing through the space formed between the water tray and the wall surface of the mechanical chamber; and a third pipe unit connected to the second pipe unit and the outlet pipe.

Preferably, the vibration reduction type refrigerator further includes a discharge pipe connected between the side of the compressor and an inlet pipe of a condenser, for discharging the refrigerants compressed by the compressor to the condenser. Here, the discharge pipe includes: a first pipe unit connected to the side of the compressor; a second pipe unit connected to the first pipe unit, for passing through the space formed between the water tray and the wall surface of the mechanical chamber; and a third pipe unit connected to the second pipe unit and the inlet pipe.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A vibration reduction type refrigerator in accordance with the most preferable embodiments of the present invention will now be described in detail with reference to the accompanying drawings.

Figure 1:
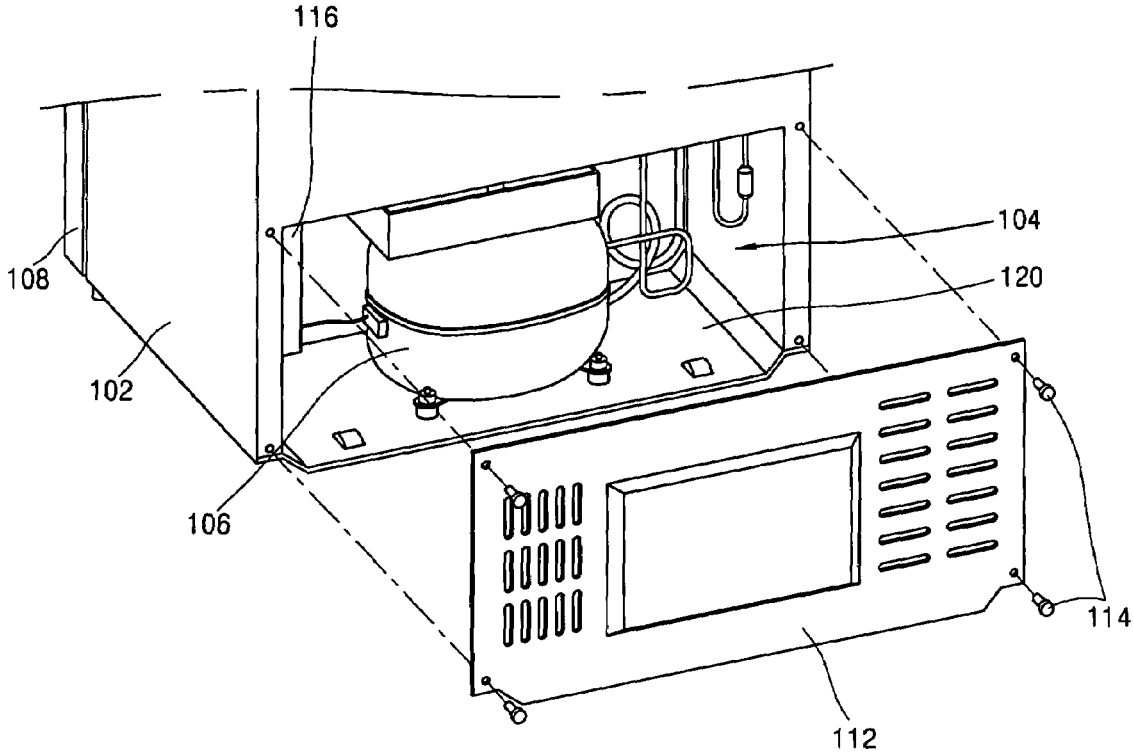
FIG. 1 CONVENTIONAL ART
FIG. 1 is a perspective view illustrating a mechanical chamber of a conventional refrigerator.
Figure 2:
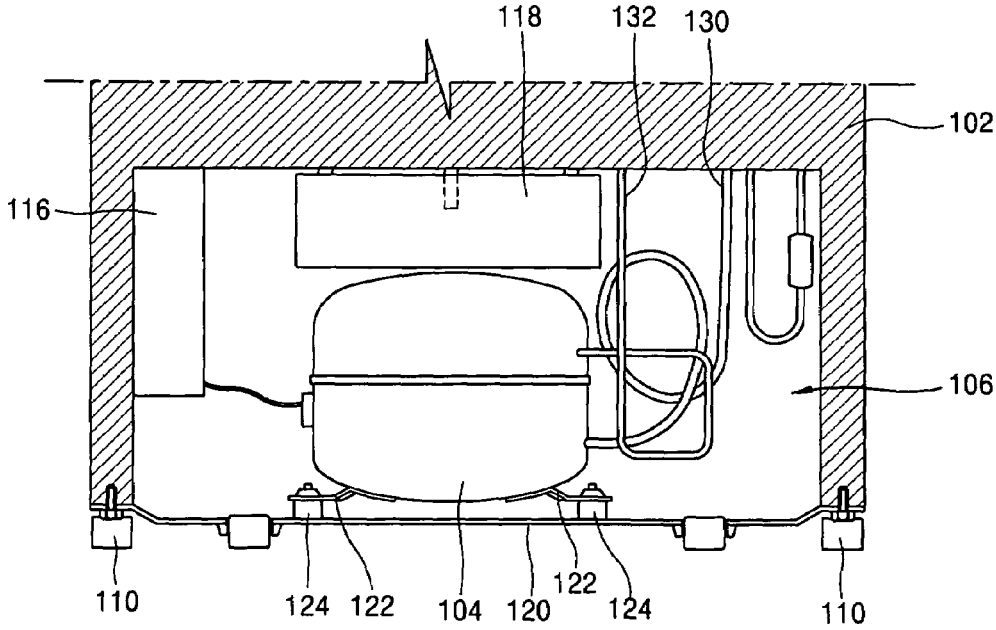
FIG. 2 CONVENTIONAL ART
FIG. 2 is a cross-sectional view illustrating the mechanical chamber of the conventional refrigerator.
Figure 3:
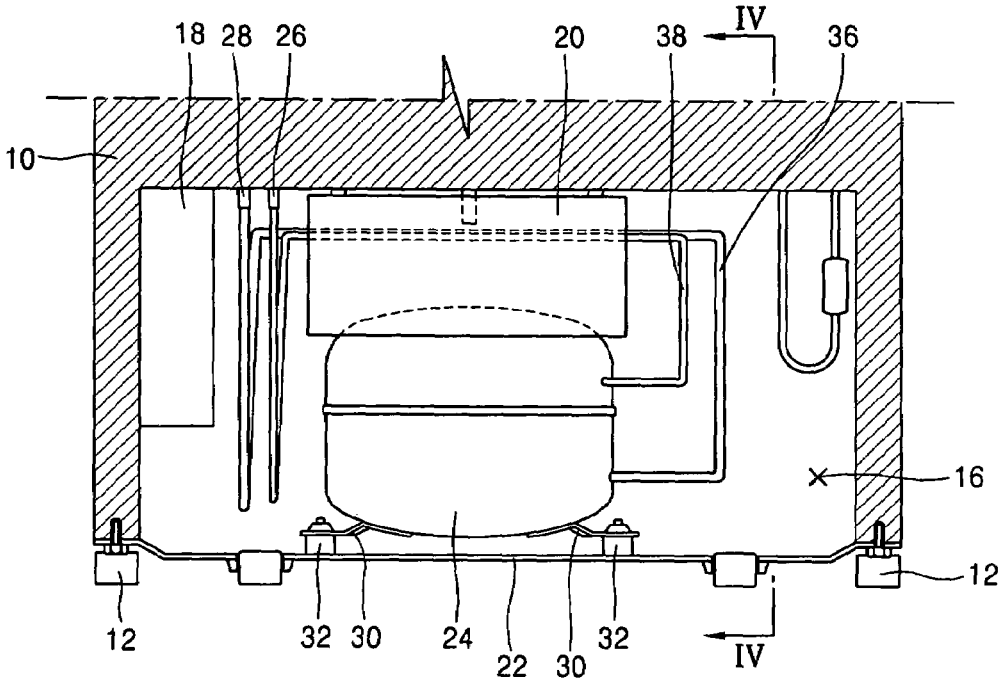
FIG. 3 is a cross-sectional view illustrating a mechanical chamber of a refrigerator in accordance with a first embodiment of the present invention.
Figure 4:
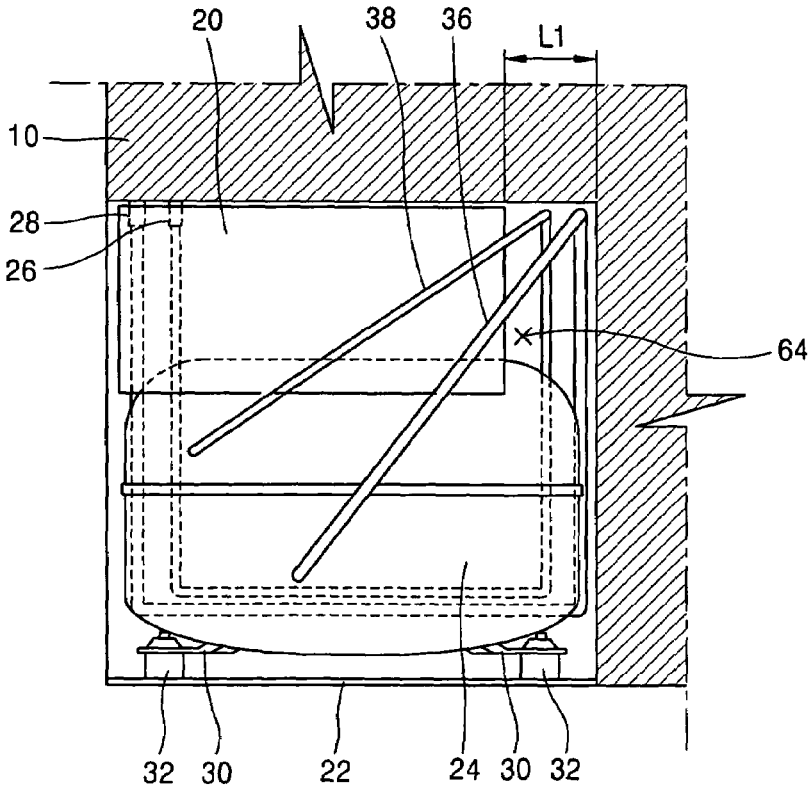
FIG. 4 is a cross-sectional view taken along line IV-IV of FIG. 3.

FIG. 3 is a cross-sectional view illustrating a mechanical chamber of a refrigerator in accordance with a first embodiment of the present invention, and FIG. 4 is a cross-sectional view taken along line IV-IV of FIG. 3.

The refrigerator includes a refrigerator main body 10 having a freezing chamber for storing frozen foods and a cooling chamber for storing cooled foods, feet 12 being mounted at the lower portion of the refrigerator main body 10, and a mechanical chamber 16 disposed at the lower portion of the refrigerator main body 102, for housing various components of a refrigeration cycle.

A control box 18 for controlling the refrigeration cycle is installed inside the mechanical chamber 16, a water tray 20 for storing water generated from the refrigeration cycle by defrosting is installed at the upper portion of the inside portion of the mechanical chamber 16, a base plate 22 is mounted on the bottom surface of the mechanical chamber 16, and a compressor 24 for compressing refrigerants is mounted on the top surface of the base plate 22. An inlet pipe 26 and an outlet pipe 28 connected respectively to a condenser (not shown) and an evaporator (not shown) mounted at the rear portion of the refrigerator main body 10 are exposed on the top surface of the mechanical chamber 16.

The compressor 24 is mounted on the base plate 22 by mounting brackets 30, and rubber vibration isolators 32 for preventing vibration generated by the compressor 24 from being transmitted to the refrigerator main body 10 are installed at the mounting brackets 30.

The compressor 24 is connected to the outlet pipe 28 through a suction pipe 36, for sucking refrigerants from the evaporator, and also connected to the inlet pipe 26 through a discharge pipe 38, for discharging the compressed refrigerants to the condenser.

Figure 5:
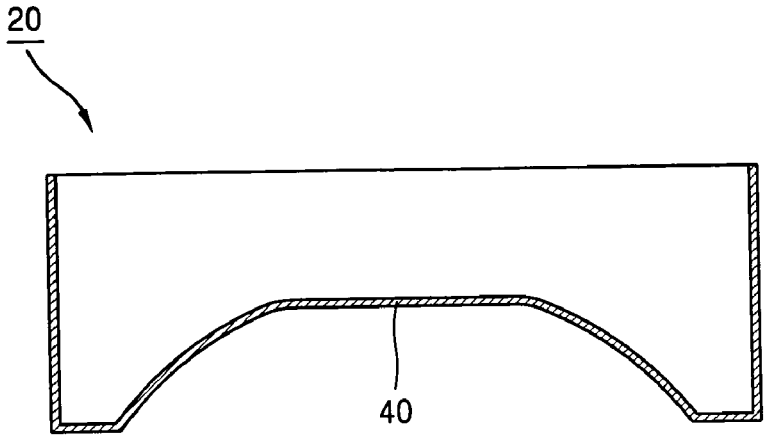
FIG. 5 is a cross-sectional view illustrating a water tray of the refrigerator in accordance with the first embodiment of the present invention.

As shown in FIG. 5, the water tray 20 is formed in a rectangular shape having its upper portion opened. The width of the water tray 20 disposed in the forward/backward direction of the refrigerator main body 10 is narrower than the width of the mechanical chamber 16, and the length of the water tray 20 disposed in the right/left direction of the refrigerator main body 10 is longer than the length of the mechanical chamber 16. As compared with the general water tray, the water tray 20 has a long length and a narrow width to obtain the same capacity. A convex unit 40 is protruded in the up direction from the bottom surface of the water tray 20, for avoiding interferences with the compressor 24.

Since the water tray 20 has a narrow width, an interval L1 can be maintained between the side of the water tray 20 and the rear wall surface of the mechanical chamber 16. A space 64 is formed between the water tray 20 and the mechanical chamber 16 due to the interval L1, and the suction pipe 36 and the discharge pipe 38 pass through the space 64.

Still referring to FIG. 3, the suction pipe 36 and the discharge pipe 38 are connected to the right side of the compressor 24, pass through the space 64 formed between the water tray 20 and the mechanical chamber 16, and are connected to the outlet pipe 28 and the inlet pipe 26 formed at the left side of the mechanical chamber 16, respectively. Accordingly, the space occupied by the suction pipe 36 and the discharge pipe 38 in the mechanical chamber 16 is minimized, and the length of the suction pipe 36 and the discharge pipe 38 is increased.

Figure 6:
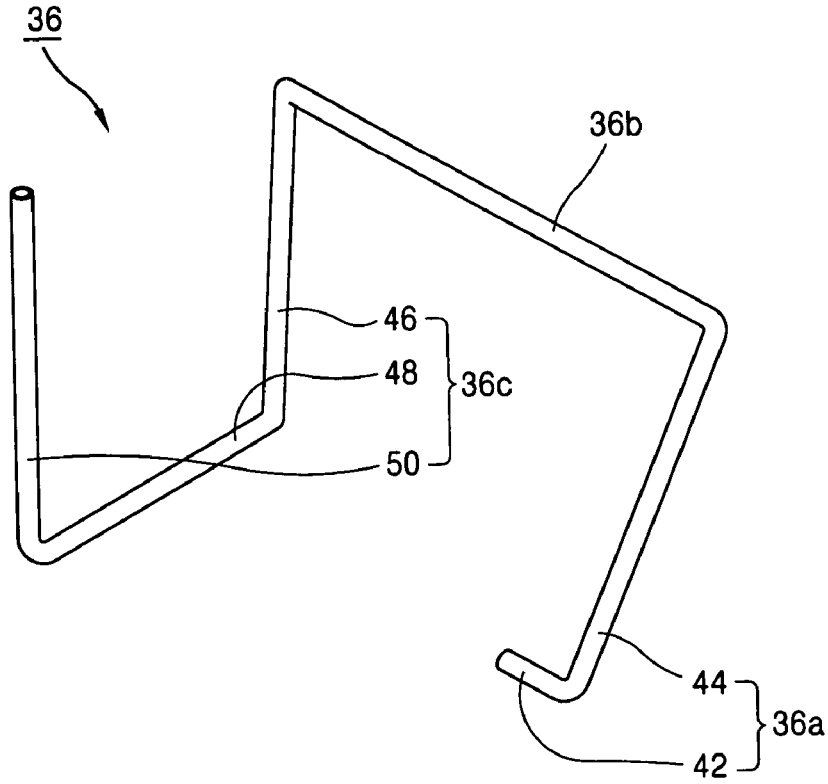
FIG. 6 is a perspective view illustrating a suction pipe of the refrigerator in accordance with the first embodiment of the present invention.

As illustrated in FIG. 6, the suction pipe 36 includes a first pipe unit 36*a* connected to the compressor 24, a second pipe unit 36*b* connected to the first pipe unit 36*a*, for passing through the space 64 formed between the water tray 20 and the wall surface of the mechanical chamber 16, and a third pipe unit 36*c* connected to the second pipe unit 36*b* and also connected to the outlet pipe 28 exposed on the top surface of the mechanical chamber 16.

Here, the first pipe unit 36*a* includes a horizontal unit 42 connected to the side of the compressor 24 and disposed in the horizontal direction, and an inclined unit 44 curved in the up direction from the horizontal unit 42, inclined to the rear portion of the mechanical chamber 16, and connected to the second pipe unit 36*b*.

The third pipe unit 36*c* includes a first curved unit 46 curved in the down direction from the end of the second pipe unit 36*b*, a second curved unit 48 curved in the horizontal direction from the first curved unit 46, and a third curved unit 50 curved in the up direction from the second curved unit 48. The third pipe unit 36*c* is wholly formed in a U shape.

Figure 7:
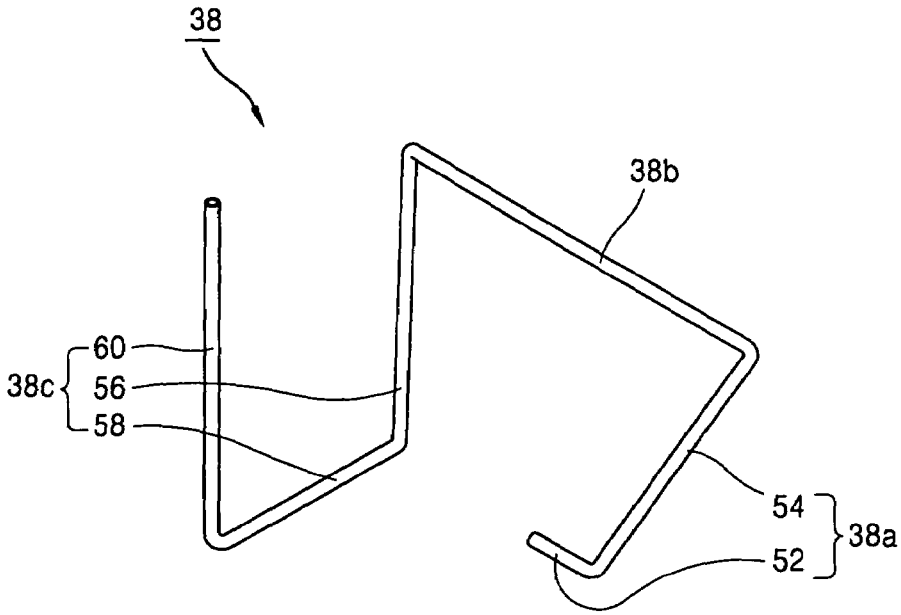
FIG. 7 is a perspective view illustrating a discharge pipe of the refrigerator in accordance with the first embodiment of the present invention.

As depicted in FIG. 7, the discharge pipe 38 includes a first pipe unit 38*a* connected to the side of the compressor 24, a second pipe unit 38*b* connected to the first pipe unit 38*a*, for passing through the space 64 formed between the water tray 20 and the wall surface of the mechanical chamber 16, and a third pipe unit 38*c* connected to the second pipe unit 38*b* and also connected to the inlet pipe 26 exposed on the top surface of the mechanical chamber 16.

Here, the first pipe unit 38*a* includes a horizontal unit 52 connected to the side of the compressor 24 and disposed in the horizontal direction, and an inclined unit 54 curved in the up direction from the horizontal unit 52, inclined to the rear portion of the mechanical chamber 16, and connected to the second pipe unit 38*b*.

The third pipe unit 38*c* includes a first curved unit 56 curved in the down direction from the end of the second pipe unit 38*b*, a second curved unit 58 curved in the horizontal direction from the first curved unit 56, and a third curved unit 60 curved in the up direction from the second curved unit 58 and connected to the inlet pipe 26. The third pipe unit 38*c* is wholly formed in a U shape.

In accordance with the first embodiment of the present invention, the suction pipe 36 and the discharge pipe 38 pass through the space 64 formed between the water tray 20 and the rear wall surface of the mechanical chamber 16, and the portions of the suction pipe 36 and the discharge pipe 38 connected to the outlet pipe 28 and the inlet pipe 26 are formed in the U shape. Therefore, the suction pipe 36 and the discharge pipe 38 have the sufficient length to reduce or extinguish the vibration generated by the compressor 24, thereby minimizing the vibration transmitted to the refrigerator main body 10.

Figure 8:
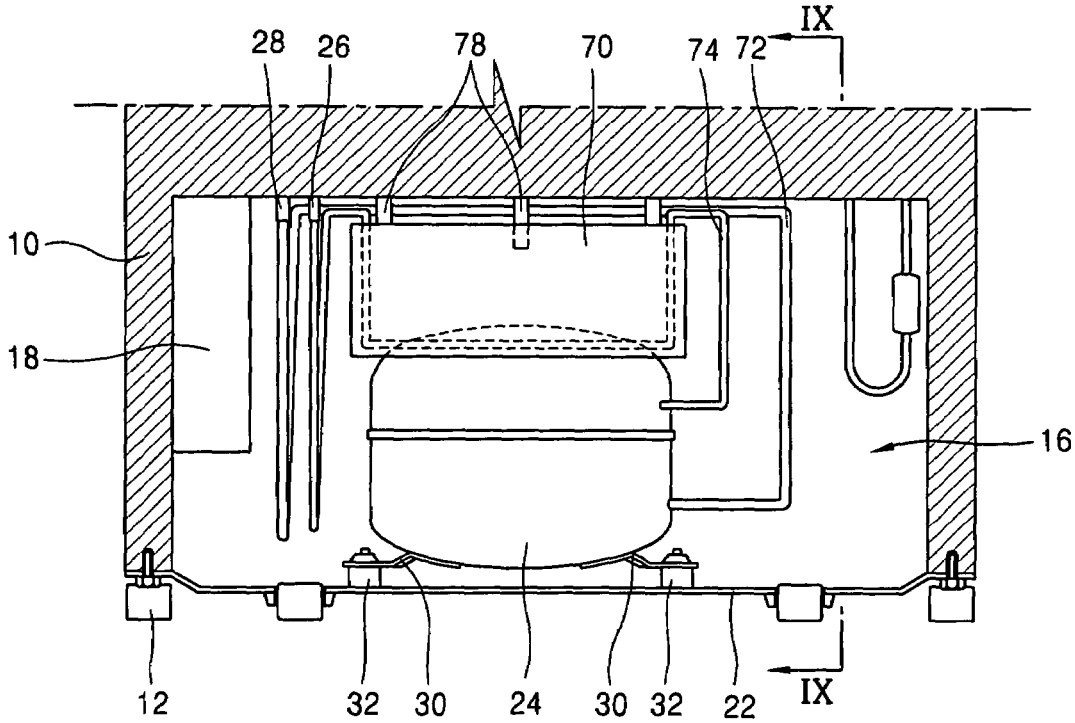
FIG. 8 is a cross-sectional view illustrating a mechanical chamber of a refrigerator in accordance with a second embodiment of the present invention.
Figure 9:
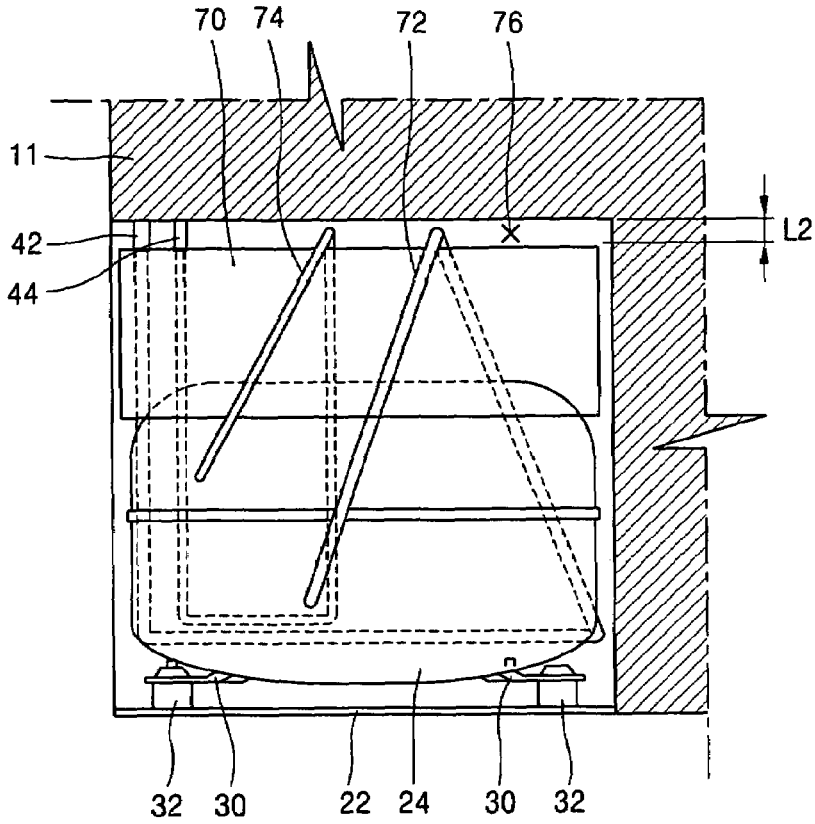
FIG. 9 is a cross-sectional view taken along line IX-IX of FIG. 8.

FIG. 8 is a cross-sectional view illustrating a mechanical chamber of a refrigerator in accordance with a second embodiment of the present invention, and FIG. 9 is a cross-sectional view taken along line IX-IX of FIG. 8.

A water tray 70 for storing water generated from a refrigeration cycle by defrosting is installed on the top surface of the mechanical chamber 16, a base plate 22 is mounted on the bottom surface of the mechanical chamber 16, and a compressor 24 for compressing refrigerants is mounted on the top surface of the base plate 22.

The compressor 24 is connected to an outlet pipe 28 through a suction pipe 72, for sucking refrigerants from an evaporator, and also connected to an inlet pipe 26 through a discharge pipe 74, for discharging the compressed refrigerants to a condenser.

The water tray 70 is formed in a rectangular box shape having its upper portion opened. The water tray 70 maintains an interval L2 from the ceiling surface of the mechanical chamber 16, for forming a space 76, and is mounted on the ceiling surface of the mechanical chamber 16 by brackets 78. The suction pipe 72 and the discharge pipe 74 pass through the space 76.

A convex unit 80 is protruded in the up direction from the bottom surface of the water tray 70, for avoiding interferences with the compressor 24.

Figure 10:
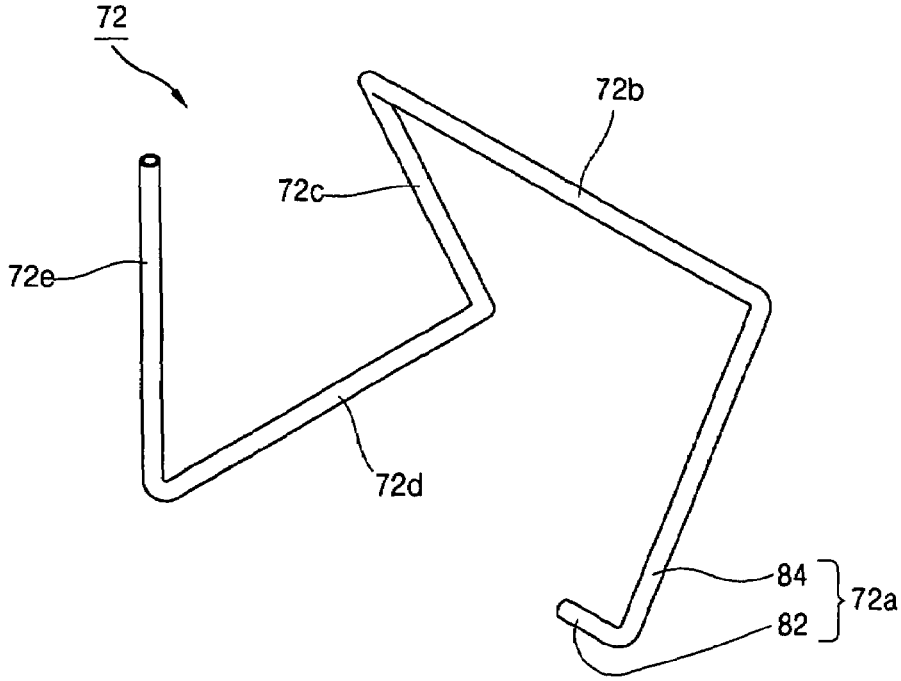
FIG. 10 is a perspective view illustrating a suction pipe of the refrigerator in accordance with the second embodiment of the present invention.

As shown in FIG. 10, the suction pipe 72 includes a first pipe unit 72*a* connected to one side of the compressor 24, a second pipe unit 72*b* connected to the first pipe unit 72*a*, for passing through the space 76 formed between the top surface of the water tray 70 and the ceiling surface of the mechanical chamber 16, a third pipe unit 72*c* curved in the down direction from the second pipe unit 72*b* and inclined to the rear portion of the mechanical chamber 16, a fourth pipe unit 72*d* curved in the horizontal direction from the third pipe unit 72*c* and disposed in the forward/backward direction of the mechanical chamber 16, and a fifth pipe unit 72*e* curved in the up direction from the fourth pipe unit 72*d* and connected to the outlet pipe 28.

The first pipe unit 72*a* includes a horizontal unit 82 connected to one side of the compressor 24 and disposed in the horizontal direction, and an inclined unit 84 curved in the up direction from the horizontal unit 82 and inclined to the rear portion of the mechanical chamber 16.

Figure 11:
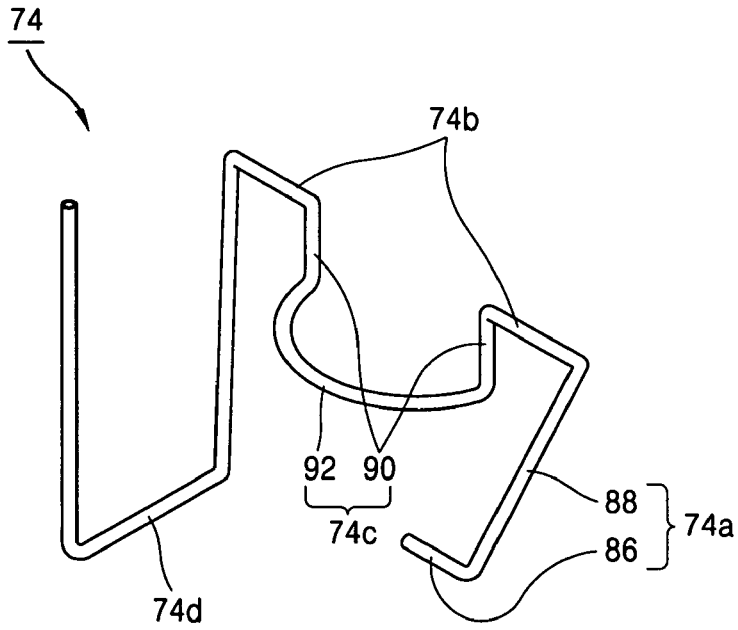
FIG. 11 is a perspective view illustrating a discharge pipe of the refrigerator in accordance with the second embodiment of the present invention.
Figure 12:
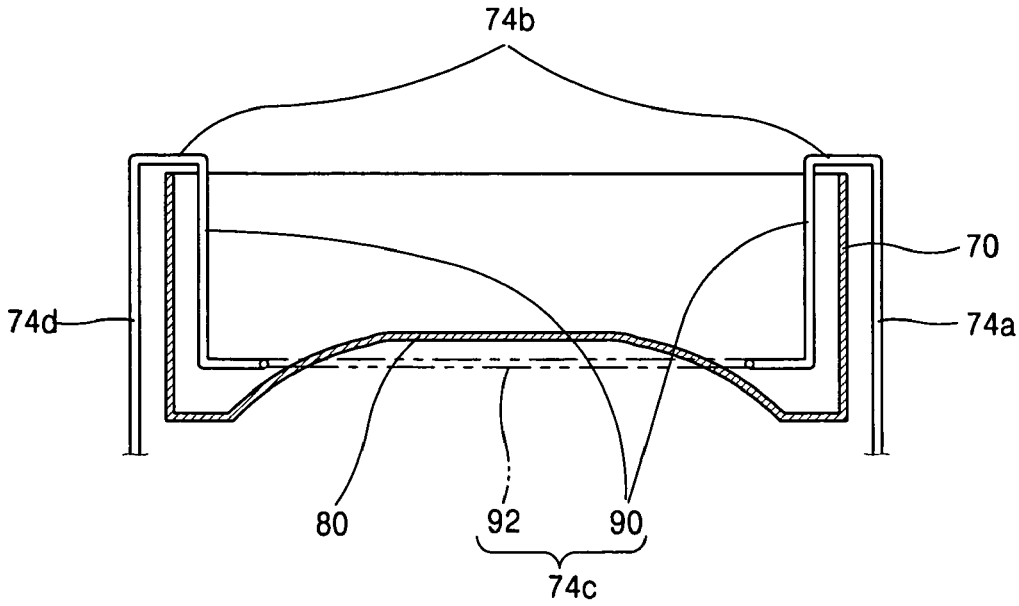
FIG. 12 is a cross-sectional view illustrating the discharge pipe disposed on a water tray in accordance with the second embodiment of the present invention.

As illustrated in FIGS. 11 and 12, the discharge pipe 74 includes a first pipe unit 74*a* connected to one side of the compressor 24, a second pipe unit 74*b* curved from the first pipe unit 74*a* and disposed in the horizontal direction, for passing through the space 76 formed between the top surface of the water tray 70 and the ceiling surface of the mechanical chamber 16, a third pipe unit 74*c* curved in the down direction from both sides of the second pipe unit 74*b*, for passing through the water tray 70, and a fourth pipe unit 74*d* curved in a U shape from the third pipe unit 74*c* and connected to the inlet pipe 26.

The first pipe unit 74*a* includes a horizontal unit 86 connected to one side of the compressor 24 and disposed in the horizontal direction, and an inclined unit 88 curved in the up direction from the horizontal unit 86 and inclined to the rear portion of the mechanical chamber 16.

Here, the third pipe unit 74*c* includes vertical units 90 curved in the down direction from both sides of the third pipe unit 74*c*, and a curved line unit 92 connected between the vertical units 90 and formed in a curved line shape along the bottom surface of the water tray 70.

In accordance with the second embodiment of the present invention, the suction pipe 72 and the discharge pipe 74 pass through the space 64 formed between the top surface of the water tray 70 and the ceiling surface of the mechanical chamber 16, and the portions of the suction pipe 72 and the discharge pipe 74 connected to the outlet pipe 28 and the inlet pipe 26 are formed in the U shape. Therefore, the suction pipe 72 and the discharge pipe 74 have the sufficient length to reduce or extinguish the vibration generated by the compressor 24.

As discussed earlier, in accordance with the present invention, the suction pipe connected between the compressor and the outlet pipe of the evaporator and the discharge pipe connected between the compressor and the inlet pipe of the condenser are disposed to pass through the space formed between the water tray and the wall surface of the mechanical chamber, respectively, to obtain the sufficient length. As a result, the vibration generated by the compressor is almost extinguished through the suction pipe and the discharge pipe, and thus rarely transmitted to the refrigerant main body.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A vibration reduction type refrigerator, comprising:

a refrigerator main body having a cooling chamber for storing foods and a mechanical chamber;

a compressor disposed in the mechanical chamber, for compressing refrigerants;

a water tray for storing water generated in the operation of a refrigeration cycle, disposed at a predetermined interval from the mechanical chamber for forming a space between the water tray and the mechanical chamber; and a suction pipe connected to the side of the compressor, disposed in the mechanical chamber in the width direction of the refrigerator main body, and connected to an outlet pipe of an evaporator disposed at one side end of the mechanical chamber;

wherein the suction pipe comprises:

a first pipe unit connected to the side of the compressor;

a second pipe unit connected to the first pipe unit, for passing through the space formed between the water tray and the wall surface of the mechanical chamber; and a third pipe unit connected to the second pipe unit and the outlet pipe.

2. The refrigerator of claim 1, wherein the water tray for storing water generated in the operation of a refrigeration cycle is mounted on the top surface of the mechanical chamber, and is disposed at a predetermined interval from the rear wall surface of the mechanical chamber, so that a space can be formed between the side of the water tray and the rear wall surface of the mechanical chamber.

3. The refrigerator of claim 2, wherein a convex unit is protruded in a convex shape from the bottom surface of the water tray, for avoiding interferences with the compressor.

4. The refrigerator of claim 1, wherein the first pipe unit comprises:

a horizontal unit connected to the side of the compressor and disposed in the horizontal direction; and an inclined unit curved in the up direction from the horizontal unit at an inclination angle.

5. The refrigerator of claim 1, wherein the third pipe unit is formed in a U shape, namely, curved in the down direction from the second pipe unit and curved in the up direction to be connected to the outlet pipe.

6. The refrigerator of claim 1, further comprising a discharge pipe connected between the side of the compressor and an inlet pipe of a condenser, for discharging the refrigerants compressed by the compressor to the condenser.

7. The refrigerator of claim 6, wherein the discharge pipe comprises:

a first pipe unit connected to the side of the compressor;

a second pipe unit connected to the first pipe unit, for passing through a space formed between a water tray and a wall surface of the mechanical chamber; and a third pipe unit connected to the second pipe unit and the inlet pipe.

8. The refrigerator of claim 7, wherein the first pipe unit comprises:

a horizontal unit connected to the side of the compressor and disposed in the horizontal direction; and an inclined unit curved in the up direction from the horizontal unit at an inclination angle.

9. The refrigerator of claim 7, wherein the third pipe unit is formed in a U shape, namely, curved in the down direction from the second pipe unit and curved in the up direction to be connected to the inlet pipe.

10. The refrigerator of claim 1, wherein a water tray is installed on a ceiling surface of the mechanical chamber at an interval from the ceiling surface of the mechanical chamber, so that a space can be formed between a top surface of the water tray and the ceiling surface of the mechanical chamber.

11. The refrigerator of claim 10, wherein the suction pipe comprises:

a first pipe unit connected to one side of the compressor;

a second pipe unit connected to the first pipe unit, for passing through the space formed between the top surface of the water tray and the ceiling surface of the mechanical chamber;

a third pipe unit curved in the down direction from the second pipe unit and inclined to the rear portion of the mechanical chamber;

a fourth pipe unit curved in the horizontal direction from the third pipe unit and disposed in the forward/backward direction of the mechanical chamber; and a fifth pipe unit curved in the up direction from the fourth pipe unit and connected to the outlet pipe.

12. The refrigerator of claim 10, further comprising a discharge pipe connected between the side of the compressor and an inlet pipe of a condenser, for discharging the refrigerants compressed by the compressor to the condenser.

13. The refrigerator of claim 12, wherein the discharge pipe comprises:

a first pipe unit connected to the side of the compressor;

a second pipe unit curved from the first pipe unit, for passing through the space formed between the top surface of the water tray and the ceiling surface of the mechanical chamber;

a third pipe unit curved in the down direction from both sides of the second pipe unit, for passing through the water tray; and a fourth pipe unit connected to the third pipe unit and the inlet pipe.

14. The refrigerator of claim 13, wherein the third pipe unit comprises:

vertical units curved in the down direction from both sides of the second pipe unit; and a curved line unit connected between the vertical units and formed in a curved line shape along the bottom surface of the water tray.

15. The refrigerator of claim 13, wherein the fourth pipe unit is formed in a U shape, namely, curved in the down direction from the second pipe unit and curved in the up direction to be connected to the outlet pipe.

16. A vibration reduction type refrigerator, comprising:

a refrigerator main body having a cooling chamber for storing foods and a mechanical chamber;

a compressor disposed in the mechanical chamber, for compressing refrigerants;

a water tray for storing water generated in the operation of a refrigeration cycle, the water tray being spaced from a surface of the mechanical chamber; and a suction pipe connected to the side of the compressor, the suction pipe extending through the space separating the water tray from the surface of the mechanical chamber, and the suction pipe being connected to an outlet pipe of an evaporator disposed at one side end of the mechanical chamber;

wherein the suction pipe comprises:

a first pipe unit connected to one side of the compressor;

a second pipe unit connected to the first pipe unit, for passing through the space formed between the top surface of the water tray and the ceiling surface of the mechanical chamber;

a third pipe unit curved in the down direction from the second pipe unit and inclined to the rear portion of the mechanical chamber;

a fourth pipe unit curved in the horizontal direction from the third pipe unit and disposed in the forward/backward direction of the mechanical chamber; and a fifth pipe unit curved in the up direction from the fourth pipe unit and connected to the outlet pipe.

17. The refrigerator of claim 16, wherein the surface of the mechanical chamber is a wall surface of the mechanical chamber.

18. The refrigerator of claim 16, wherein the surface of the mechanical chamber is a ceiling surface of the mechanical chamber.

19. A vibration reduction type refrigerator, comprising:

a refrigerator main body having a cooling chamber for storing foods and a mechanical chamber;

a compressor disposed in the mechanical chamber, for compressing refrigerants;

a water tray for storing water generated in the operation of a refrigeration cycle, the water tray being spaced from a surface of the mechanical chamber; and a discharge pipe connected to the side of the compressor, the discharge pipe extending through the space separating the water tray from the surface of the mechanical chamber, and the discharge pipe being connected to an inlet pipe of a condenser;

wherein the discharge pipe comprises:

a first pipe unit connected to the side of the compressor;

a second pipe unit curved from the first pipe unit, for passing through the space formed between the top surface of the water tray and the ceiling surface of the mechanical chamber;

a third pipe unit curved in the down direction from both sides of the second pipe unit, for passing through the water tray; and a fourth pipe unit connected to the third pipe unit and the inlet pipe.

20. The refrigerator of claim 19, wherein the surface of the mechanical chamber is a wall surface of the mechanical chamber.

21. The refrigerator of claim 19, wherein the surface of the mechanical chamber is a ceiling surface of the mechanical chamber.

* * * * *